United States Patent [19]

Liang

[11] Patent Number: 4,752,184

[45] Date of Patent: Jun. 21, 1988

[54] SELF-LOCKING OUTER AIR SEAL WITH FULL BACKSIDE COOLING

[75] Inventor: George Liang, Palm City, Fla.

[73] Assignee: The United States of America as represented by the Secretary of the Air Force, Washington, D.C.

[21] Appl. No.: 861,908

[22] Filed: May 12, 1986

[51] Int. Cl.[4] ..... F01D 11/08

[52] U.S. Cl. ..... 415/116; 415/174; 415/180

[58] Field of Search ..... 415/115, 116, 117, 136, 415/138, 170 R, 171, 173 A, 174, 175, 178, 180, 200

[56] References Cited

U.S. PATENT DOCUMENTS

| | | | |
|---|---|---|---|
| 3,583,824 | 6/1971 | Smuland | 415/117 |
| 3,825,364 | 7/1974 | Halila et al. | 415/116 |
| 3,836,279 | 9/1974 | Lee | 415/116 |
| 3,975,901 | 8/1976 | Hallinger et al. | 60/39.14 |
| 4,023,919 | 5/1977 | Patterson | 415/174 X |
| 4,222,707 | 9/1980 | Drouet et al. | 415/116 |
| 4,230,436 | 10/1980 | Davison | 415/1 |
| 4,251,185 | 2/1981 | Karstensen | 415/116 X |
| 4,303,337 | 12/1981 | Eckert | 415/116 |
| 4,317,646 | 3/1982 | Steel et al. | 415/116 |
| 4,329,113 | 5/1982 | Ayache et al. | 415/116 |
| 4,497,610 | 2/1985 | Richardson et al. | 415/175 X |
| 4,526,226 | 7/1985 | Hsia et al. | 165/109 R |
| 4,596,116 | 6/1986 | Mandet et al. | 415/174 X |

FOREIGN PATENT DOCUMENTS

| | | | |
|---|---|---|---|
| 2540938 | 8/1984 | France | 415/170 R |
| 2103294 | 2/1983 | United Kingdom | 415/174 |

*Primary Examiner*—Robert E. Garrett
*Assistant Examiner*—Joseph M. Pitko
*Attorney, Agent, or Firm*—Jules J. Morris; Donald J. Singer

[57] ABSTRACT

An air seal assembly 10 for a gas turbine engine comprising a full ring cover plate 20 and seal segment 14 attached to impingement boxes 18. The impingement boxes have counter mounted hooks 24, 26 that interlock with a turbine flange 22 and cover plate 20 to secure the seal assembly 10. Holes 36 in the impingement boxes 18 direct cooling air to the entire backside 38 of seal 14. Seals 14 are mounted to the impingement boxes 18 by pedestals 40 that are positioned to enhance seal flexibility since axial edges are unrestrained.

3 Claims, 2 Drawing Sheets

SELF-LOCKING OUTER AIR SEAL WITH FULL BACKSIDE COOLING

STATEMENT OF GOVERNMENT INTEREST

The invention described herein may be manufactured and used by or for the Government for governmental purposes without the payment of any royalty thereon.

BACKGROUND OF THE INVENTION

The invention relates to air sseals for use in turbo-machinery, and, more particularly to air seals with increased cooling and flexibility.

In turbo-machinery, such as gas turbine engines for aircraft, a flow of high pressure gas is directed onto a plurality of turbine blades mounted upon rotatable disks. The gas imparts momentum to the turbine blades in a manner which transforms the kinetic energy of the gas flow into torque to operate rotating elements. Gas turbine efficiency depends to a great degree upon directing the high pressure gas (working fluid) onto the plurality of turbine blades while restricting the high pressure gas from bypassing around the tips of the turbine blades. When gas is allowed to bypass the blades, the gas turbine engine looses efficiency due to the unapplied loss of useable kinetic energy.

In view of the above, gas turbine engines incorporate a turbine casing having air seals which surround the turbine blades and define the outer flow path of the pressurized gas in the vicinity of the blades. Clearance gaps between the radial blade tips and the air seals permits a portion of the working fluid to bypass the rotating blades.

In order to minimize efficiency losses due to unrestricted flow of the working fluid it is important to minimize the air gap between the rotating turbine blades and the turbine casing. If the air gap is made too small, however, another problem arises. During engine startup or acceleration turbine blade temperature increases rapidly, which in turn results in an increase in turbine blade size due to the thermal expansion. The turbine casing and the other non-rotating elements of the turbine such as the air seals, do not heat as rapidly as the turbine blades and therefore do not expand as quickly as the turbine blades. This can result in destructive contact between the turbine blades and the casing. This problem is particularly important in turbine machinery where the critical clearance required to maintain high efficiency is quite small. As a result of this problem, modern turbine engines make use of annular air seal shrouds supported adjacent to the rotating turbine blades by the turbine case. The shrouds' internal surface is coated with a ceramic material that withstands high turbine temperatures and permits some non-destructive rubbing between the turbine blades and the shroud in order to help maintain very small clearances.

It has been an object in modern gas turbine engines to provide air seals that can withstand thermal and phyical stresses in close proximity to both a very high temperature, high pressure gas stream and the rotating high temperature turbine blades. This has been efficiently done through the use of cooling air being directed onto the outer, or back surface, of the air seal itself. This air is generally relatively cool compressor air that has been bypassed around the engine combustor and directed to the air seals. This air helps control air seal temperature (and thermal expansion) by heating the air seal during engine startup and cooling it during steady state operation.

The bypass air cooled seal therefore allows the turbine to operate at elevated temperatures by providing a cooling system which prevents damage to the air seal due to the effects of high turbine temperatures.

This system has generally worked well for the current generation of aircraft engines. Certain shortcomings, however, have arisen in recent years due to the drive for more efficient and more powerful aircraft engines. In order to raise the efficiency of a gas turbine engine it is generally necessary to raise the turbine operating temperature. It is therefore not unusual for modern turbine operating temperatures to be in the range of 2000° F. at high power settings. These higher temperatures have resulted in seal buckling and deterioration that has decreased air seal life and resulted in lowered long term engine performance due to increased air gaps between turbine blades and the air seals (shrouds).

An example of conventional turbine air seal is disclosed in U.S. Pat. No. 3,583,824 to Smuland et al. The Smuland patent discloses an air seal wherein bypass air is directed through a perforated baffle 54 and impinges on the back of a turbine shroud (air seal) 26. The air therefore cools the center section of the shroud and exits through a hole 66 to eventually join with the air stream passing by turbine blades 24. This type of cooling system has been generally successful.

New problems, hwoever, have recently developed in high temperature engines. The Smuland device makes no provision for direct cooling of either axial end of the shroud 26; the cooling air goes mainly in the center two-thirds of the shroud. Turbines utilizing seals such as these have had problems with shroud edges becoming burnt or buckled. To solve these problems, angled holes have been drilled through the shroud material to deliver cooling air to the edges of the air seal. This in turn has resulted in an increased cooling air flow that lowers engine efficiency. In addition, manufacturing air seals with these small angled holes is quite expensive and difficult. Further, the holes are subject to blockage since they are quite long and relatively small diameter. When the holes are blocked shroud failures can occur due to overheating.

Secondary air seals have also been added to this type of design to control bypass air flow and minimize its effect on efficiency. Thus it can be seen that turbine air seals can be quite complex and difficult to manufacture.

A primary object of this invention therefore, is to provide a cooling system for turbine air seals that will allow turbine operation at increased temperatures without damage to the seal material.

Another object of this invention is to provide a cooling system which provides positive seal edge cooling.

A further object of this invention is to increase air seal flexibility to allow for seal thermal growth and contraction without buckling.

Yet another object of this invention is to eliminate difficult machining operations for air seal manufacture.

SUMMARY OF THE INVENTION

The invention comprises an air seal assembly for turbine engines having a turbine case forming the outer portion of the engine and a turbine rotor positioned within the turbine case for rotation. The air seal assembly comprises an air seal for limiting unrestricted air flow between the turbine rotor and the turbine case. The air seal has interlocking hook portions for attachment to a flange of the turbine case having mounting slots positioned therein. A full ring cover plate is used to complete the mounting of the seal within the turbine case, the cover plate having a slotted flange for interlocking with a counter mounted second set of hooks on the air seal. Assembly of the cover plate locks the air seal into place.

In the preferred embodiment of the invention the air seal assembly further comprises an impingement box for controlling and restricting cooling bypass air flow to the seal portion most adjacent to the turbine rotor. The impingement box has air flow restricting holes for directing the cooling air flow.

The air holes of the impingement box direct the cooling air flow to substantially all of the seal portion most adjacent to the impingement box. Further the impingement box serves to limit cooling air flow to a desired level sufficient to cool the seal portion efficiently while not allowing an inefficient percentage of this engine cooling bypass air to escape through the cooling passages.

The seal portion of the air seal assembly comprises a ceramic seal connected to the impingement box by local pedestals. The ceramic seal portion is placed most adjacent to the turbine rotor in order to restrict uncontrolled air flow past turbine blades mounted on the turbine rotor.

The pedestals which attach the ceramic air seal to the impingement box are positioned to allows seal flexibility during operation. This increases flexibility extends seal life by lowering stress on the ceramic seals and preventing ceramic seal buckling and cracking.

A further aspect of the preferred embodiment of the invention is that the ceramic air seal portion comprises several semi-annular sections that are assembled to form a full ring in the turbine case adjacent to the turbine rotor.

In order to further control bypass air flow, secondary air seals are positioned between adjacent impingement boxes and between impingement boxes and adjacent sections of the turbine.

BRIEF DESCRIPTION OF THE DRAWINGS

The foregoing and other objects and advantages of the invention will be apparent from the following more particular description of the preferred embodiment of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE INVENTION

Figure 1:
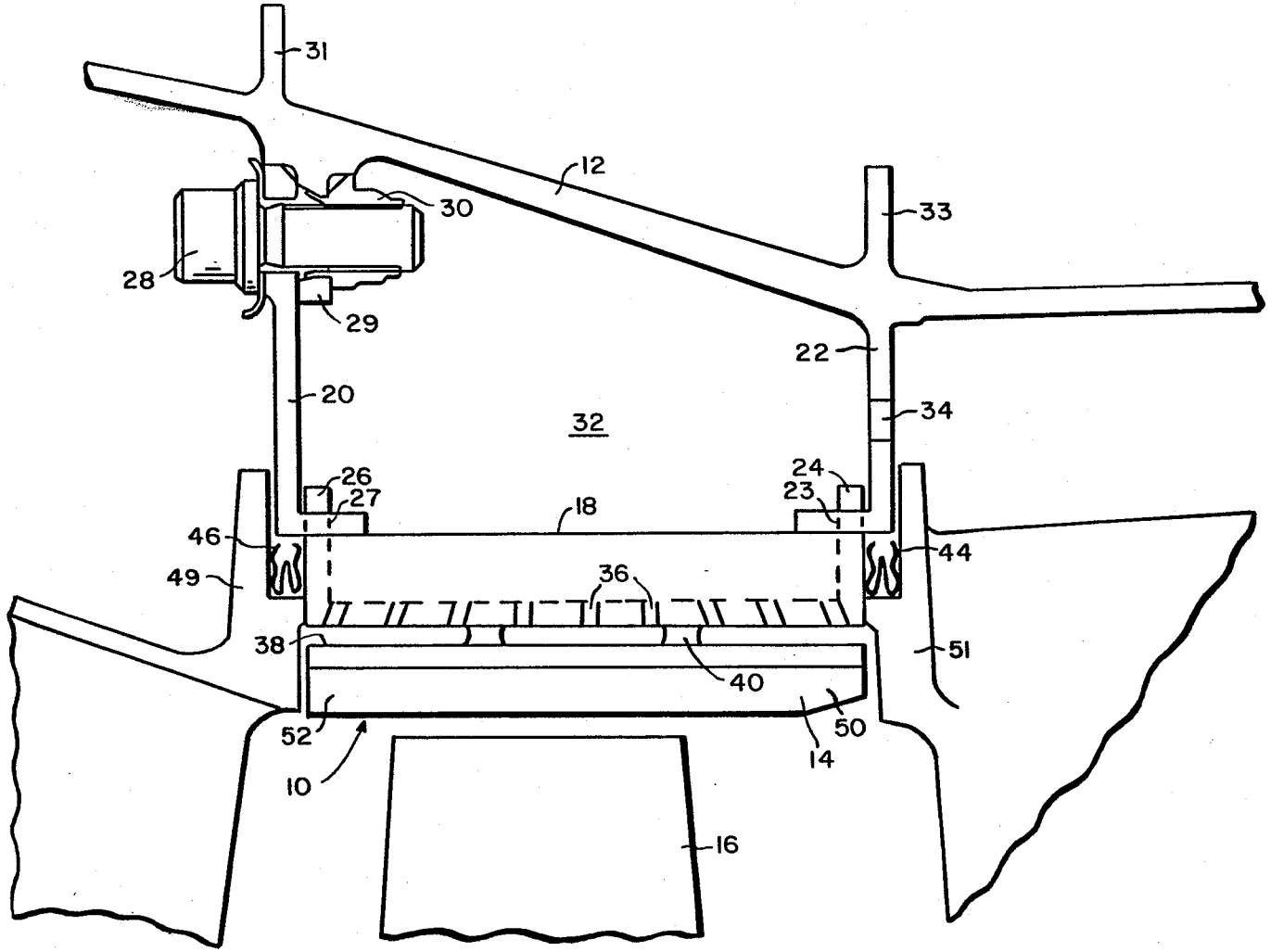
FIG. 1 is a cross sectional view of a section of a gas turbine particularly showing the turbine case and air seal.

The invention comprises a seal assembly 10 for attachment to a turbine case 12. The seal assembly includes a ceramic seal 14 that is positioned adjacent to a multitude of turbine rotor blades 16 in order to minimize unrestricted passage of air through the turbine.

The turbine seal assembly 10 incorporates a self-locking assembly and a ceramic seal with full backside cooling. The seal assembly comprises three basic elements: an impingement box 18, a full ring cover plate 20 and the ceramic seal 14.

Figure 2:
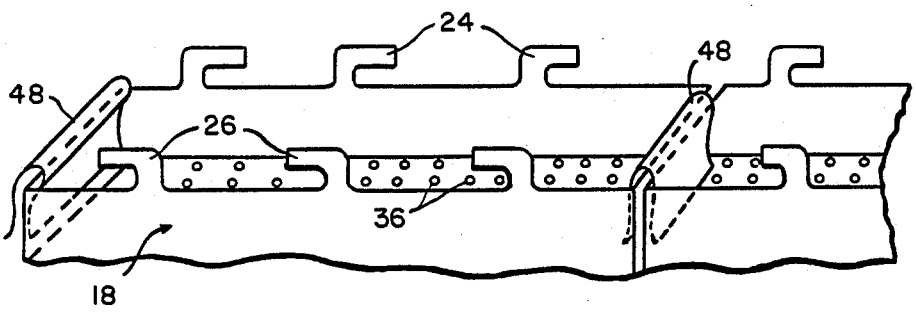
FIG. 2 is a perspective view of an impingement box used in the seal assembly of FIG. 1.

The impingement case, or box, 18 includes the seal 14 and mounts onto turbine flange 22 with hooks 24 (FIG. 2). Flange 22 of turbine case 12 has slots 23 which accept hooks 24 of the impingement box. Similar slots 27 in cover plate 20 accept counter mounted hooks 26 of the impingement box 18.

Figure 3:
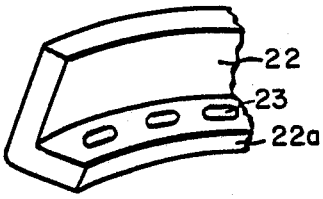
FIG. 3 is a partial perspective view of a turbine case flange used in mounting the air seal of FIG. 1.

Initially, hooks 24 are slid into slots 23 on L-shaped section 22A (FIG. 3) of flange 22. The cover plate 20 is then used to lock the seal assembly into place when impingement plate hooks 26 are slid into slots 27 and the cover plate 20 is attached to the turbine case 12. In the view of FIG. 1, bolts 28 and internal turbine mounting flange 29 with backing nuts 30 are used to attach cover plate 20 to the turbine case but other arrangements may be used to attach the cover plate to the turbine case. External turbine flanges 31, 33 improve dimensional stability of the turbine case during thermal changes and thereby diminish thermal effects on the seal attachment points.

Seal assembly 10 has been particularly devised to improve seal cooling at the seal's axial edges 50, 52 without increasing cooling air leakage. Cooling air enters an annular chamber, or plenum, 32 through cooling air inlet hole 34 in the turbine flange 22. The cooling air is then trapped within the annular plenum 32 formed by the turbine case, the cover plate and the impingement box 18. Flow restricting holes 36 are positioned in the impingement box 18 to direct cooling air flow from the plenum 32 to the entire backside 38 of seal 14. The flow restricting holes 36 allow sufficient air flow to cool the seal 14 without permitting unrestricted air flow which might affect engine efficiency. The impingement box, in combination with the cover plate and turbine case, greatly decreases cooling air leakage that might otherwise effect engine efficiency. While sufficient cooling air must be directed to seal 14 in order to cool the seal from the effects of the heated turbine air flowing past the seal face 42, too great a flow of bypass cooling air decreases engine efficiency since this use of pressurized air flow does not apply the kinetic energy of the air flow.

In some instances it may be necessary to add secondary cooling air seals to reduce cooling air flow leakage. Cover plate 20 comprises a full ring, or annulus that encloses chamber 32. The remainder of the seal assembly comprises annular segments as shown in FIG. 2. Six, eight or more segments are used to complete an annular ring that completely surrounds the turbine rotor having blades 16. Seals 48 are used to seal between the impingement boxes 18 while seals 44 and 46 are used to seal between impingement box attachment points and adjacent stationary vane stages 49, 51 of the turbine.

Seal 14 is preferably connected to the impingement box by local pedestals 40 which do not significantly interfere with the cooling air flow from holes 36. Preferably, pedestals 40 are attached to a substrate layer 15 upon which is positioned the ceramic material 14. The substrate material is preferably metallic with a good heat transfer coefficient that aids in cooling the ceramic seal by transferring heat energy to cooling air passing through holes 36.

Local pedestals 40, in addition to allowing full backside cooling of seal 14, can be mounted so as to increase seal 14 flexibility. The pedestals 40 are mounted away from the leading and trailing edges 50, 52 of the seal 14 to allow for greater flexibility than in the conventional seals mountings where seal edges are restrained. As a result of this increase in seal flexibility, cracking of ceramic seal material due to thermal expansion is minimized and seal life is extended.

The counter mounted hook configuration used on either side of the impingement box 18 serves both to accurately lock the seal in place adjacent to rotor blades 16 and to simplify seal design and construction. A number of conventional cooling air leakage paths have been eliminated and bypass cooling air flow is largely restricted to cooling air holes 36 in impingement box 18. Cooling holes are not required in the seal portion 14, thus eliminating an expensive machining operation. Further, the increased cooling and increase seal flexibility combine to produce a seal capable of extended useful life in high temperature environments. Most significantly, full edge cooling at seal edges 50, 52 prevents seal edge failures that often occurs with conventional seals.

While the invention has been particularly described with reference to the preferred embodiment thereof, it will be understood by those skilled in the art that various changes in substance and form can be made therein without departing from the spirit and scope of the invention as detailed in the attached claims.

I claim:

1. An air seal assembly for a turbine engine comprising a turbine case forming an outer portion of said turbine engine and a turbine rotor portion positioned for rotation within said turbine base, and wherein said air seal assembly comprises:

(i) an air seal having a ceramic portion for limiting unrestricted air flow between said turbine rotor and said turbine case, said air seal having interlocking hook portions for attachment to a flange of said turbine case having mounting slots positioned therein;

(ii) a full ring cover plate for mounting to said turbine case, said cover plate having a flange with slots formed to interlock with hooks on said air seal in a manner which locks said air seal into place (iii) an impingment box for restricting cooling air flow, from an annular plenum, the impingment box having flow restricting air holes for directing cooling air flow to substantially all of said ceramic seal portion most adjacent to the impingement box; and (iv) attachment means connecting said impingement box and said ceramic portion, said attachment means comprising local pedestals mounted away from edges of said ceramic portion to allow for enhanced seal flexibility and unrestricted cooling air flow adjacent to said seal portion.

2. The air seal assembly of claim 1 wherein said air seal comprises several semi-annular sections that form a full ring when assembled to said turbine case.

3. The air seal assembly of claim 2 further comprising secondary air seals, which are used to prevent cooling air leakage between said semi-annular sections of said air seals.

* * * * *